United States Patent [19]

Jensen

[11] Patent Number: 4,538,364

[45] Date of Patent: Sep. 3, 1985

[54] APPARATUS HAVING BOTTOM AIR CHANNELS FOR AIR DRYING OF GRAIN IN A DRYING STORE AND FOR CONVEYING THE GRAIN AWAY FROM THE STORE

[76] Inventor: Anton B. Jensen, Ribevej 20, 6500 Vojens, Denmark

[21] Appl. No.: 530,577

[22] PCT Filed: Dec. 23, 1982

[86] PCT No.: PCT/DK82/00115

§ 371 Date: Aug. 25, 1983

§ 102(e) Date: Aug. 25, 1983

[87] PCT Pub. No.: WO83/02264

PCT Pub. Date: Jul. 7, 1983

[30] Foreign Application Priority Data

Dec. 28, 1981 [DK] Denmark ..... 5775/81

[51] Int. Cl.[3] ..... F26B 19/00

[52] U.S. Cl. ..... 34/233; 34/170; 34/175; 34/236; 406/88; 406/109

[58] Field of Search ..... 34/170, 233, 236, 175; 406/84, 88, 109

[56] References Cited

U.S. PATENT DOCUMENTS

| | | | |
|---|---|---|---|
| 1,220,131 | 3/1917 | Jenkins | 34/175 |
| 1,394,269 | 10/1921 | Bourdet | 34/170 |
| 2,622,341 | 12/1952 | Finnegan | 406/109 |
| 2,701,920 | 2/1955 | Campbell | 34/170 |
| 3,210,127 | 10/1965 | Schaben et al. | 406/109 |
| 3,406,955 | 10/1968 | Kowalenko | 34/233 |
| 3,836,288 | 9/1974 | Evans | 406/109 |

FOREIGN PATENT DOCUMENTS 1420068 5/1973 United Kingdom .

*Primary Examiner*—Edward G. Favors
*Assistant Examiner*—Steven E. Warner
*Attorney, Agent, or Firm*—Antonelli, Terry & Wands

[57] ABSTRACT

On the bottom surface of a store or silo for granular material is placed a system of air channels, which are at one end connected both with an outlet sluice for the grain material and with a blower housing, which is also connected with the free atmosphere. The blower housing is switchable between blowing drying air into the grain through the channels and through wall openings therein and sucking out air from the channels for outlet conveying the grain inwardly through the wall openings and further through the channels to the outlet sluice. By this suction emptying arrangement dust problems in the store are eliminated, and the necessary motor effect is surprisingly low.

9 Claims, 7 Drawing Figures

FIG. 1
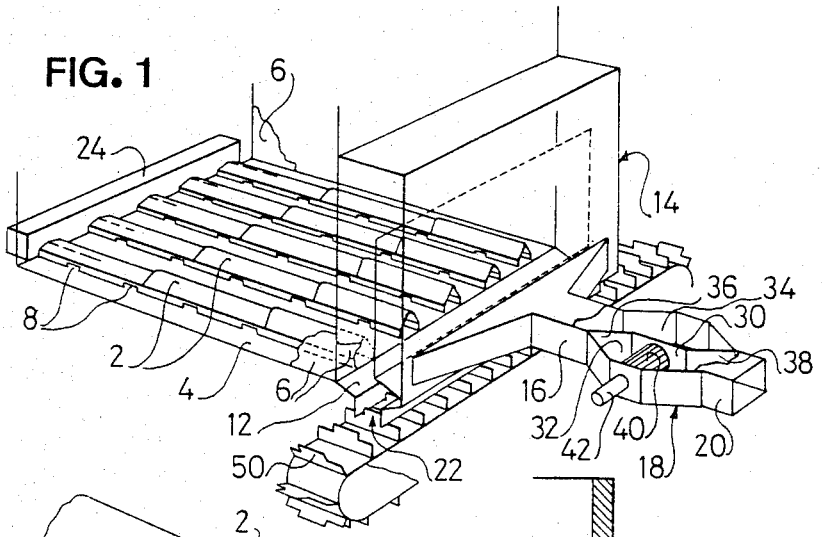
FIG. 2
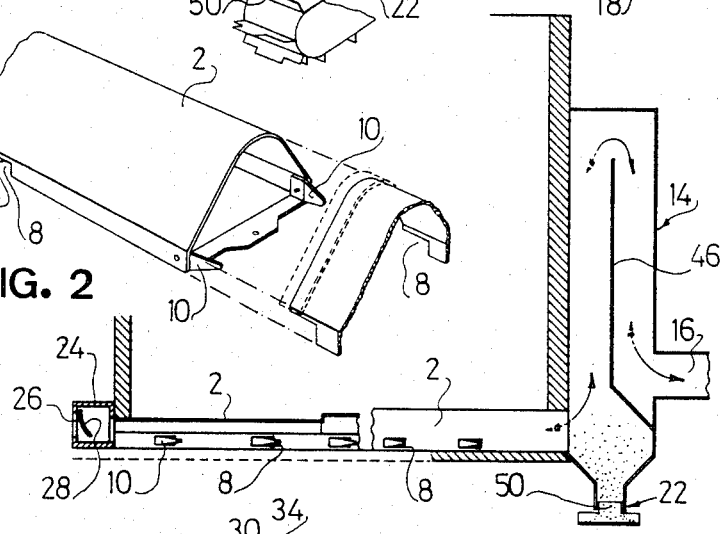
FIG. 3
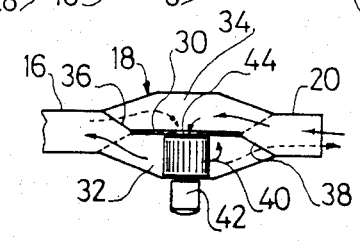
FIG. 4

APPARATUS HAVING BOTTOM AIR CHANNELS FOR AIR DRYING OF GRAIN IN A DRYING STORE AND FOR CONVEYING THE GRAIN AWAY FROM THE STORE

BACKGROUND AND SUMMARY OF THE INVENTION

The present invention relates to an apparatus for air drying a granular material in a drying store and for pneumatical emptying of the store, comprising a plurality of air channels extending along a bottom surface of the store and provided with wall openings for the inlet of drying air from the channels into the material and for the outlet of the material from the store through the channels, the channels being connected with means for blowing drying air into the channels and means for providing a flow of conveying air through the channels towards a collector area for the material to be exhausted from the store. Such an apparatus is known from the Danish patent application No. 1878/81. In that apparatus the grain as filled into the drying store onto the bottom channels may be subjected to drying air, which is blown into the channels from one end thereof, while the opposite end is closed by a valve, whereby the air will be forced out into the grain through the wall openings of the channels. Corresponding apparatus were previously known, in which the channels were permanently closed at said opposite end, and in which the air was blown out obliquely forwardly and outwardly through the wall openings, whereby the grain in the bottom layer between the channels was correspondingly affected by a force component forwardly along the channels, i.e. forwardly through the space between each pair of parallel channels. In this latter arrangement the air was usable for conveying the grain out of the store subsequent to the drying of the grain by opening outlet openings located between the channels adjacent their other or closed end and if necessary, also by increasing the air flow. However, considerable dust problems are created in the store in such a system and, moreover, a powerful blower is necessary. In the first described known apparatus, the grain is conveyed out of the store by opening the channel ends, which are closed during the drying, and by making use of guide plates mounted adjacent the channel wall openings so as to project forwardly and inwardly into the channels, whereby the blower air will flow through the channels and thereby, by injector action, suck grain into the channels through the wall openings. The grain will thus be successively drawn into the channels and be let out therethrough, whereby the dust problems are drastically reduced, just as it will be unimportant that during the drying some intrusion of grain will take place into the channels through the wall openings thereof. However, a dust problem still exists to a certain degree, and it is still necessary to utilize a considerable blower capacity for effecting the outlet conveying of the grain.

The present invention is based on the recognition that the outlet conveying of the grain for emptying the store is advantageously effected by way of an active suction from the outlet end of the channels. It has been observed that the bottom mounted channels are thereby able to effectively suck in the grain through the wall openings with the result that the aforementioned dust problem is not only reduced, but really eliminated, and that the necessary power effect for the outlet conveying of the grain is considerably reduced as compared with the known apparatus, without any change of the ability of the apparatus or the channels to introduce drying air into the grain through the wall openings of the channels by means of a suitable blower.

Therefore, it is possible with the invention to utilize one and the same blower for effecting both the blowing in of drying air and the conveying suction, since the blower may be connected with the outlet end of the channels through a suction/blowing switch system, whereby for the blowing in of the drying air it will be unimportant that the air through the channels is supplied with inversed direction relative the known apparatus.

In this connection the invention comprises a special blower unit containing a continually operating blower, which is switchable between blowing and suction operation solely by means of switch valves in a specially designed blower housing.

BRIEF DESCRIPTION OF THE DRAWINGS

In the following the invention is explained in more detail with reference to the drawing, in which:

FIG. 1 is a schematic perspective view of an apparatus according to the invention, FIG. 2 is a detailed view of the channel design therein, FIG. 3 is a longitudinal sectional view of the apparatus, FIG. 4 is a sectional top view of a blower housing thereof.

DETAILED DESCRIPTION OF THE DISCLOSED EMBODIMENTS

Figure 5:
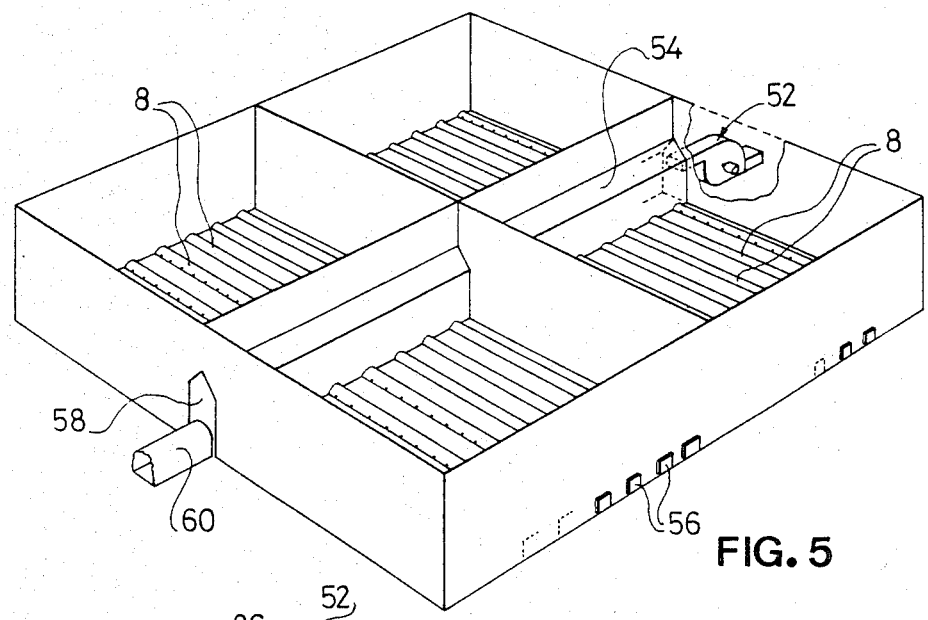
FIG. 5 is a perspective view of a modified apparatus.

The apparatus as shown in FIG. 1, except for the associated air supply system, roughly corresponds to the apparatus according to the Danish patent application No. 1878/81. It comprises a plurality of parallel air channels 2 mounted mutually spaced on a flat bottom surface 4 of a grain store, the four side walls 6 of which are shown schematically only. As also shown in FIG. 2 the channels or ducts 2 are designed as inverted U- or V-shaped profiles, the opposed lower side walls of which are provided with a row of rectangular openings 8. Adjacent one of their end edges these openings are provided with an obliquely inwardly and forwardly projecting guiding plate 10 shaped as a pointed flap.

Adjacent their front ends, to the right in FIG. 1, the channels 2 penetrate the front wall 6 of the store and thereby debouch into a space which is extended downwardly into a hopper 12 and forwardly into an air box 14, which through a channel 16 is connected with one end of a blower housing 18, the opposite end of which is connected to the free atmosphere through a channel 20. The hopper 12 leads downwardly to a delivery area for the grain as filled into the drying store, the hopper if necessary being provided with an outsluicing system 22 or another kind of outlet valve means operable to counteract a free air intake upwardly through the hopper 12.

At their opposite ends the channels 2 are connected with a box 24, see also FIG. 2, having in its rear wall a slot 26, inside which is mounted a flap valve shaped as a rubber strip 28, which is fastened to the wall along the top edge of the slot 26, whereby air may well be sucked into the channels 2 through the slot 26, but not be blown out therethrough from the ends of the channels 2.

The blower housing 18 forms a widened element between the associated channels or ducts 16 and 20 and is provided with a longitudinal middle wall 30, which separates the housing into two parallel channel portions 32 and 34 and is, at both its opposite ends, provided with a hinged valve flap 36 and 38, respectively, these flaps being operable to be switched over in counterphase such that the two channel portions 32 and 34 will be invertedly and individually connectable with either one or the other of the channels 16 and 20, respectively.

In the channel portion 32 is mounted a radial blower 40 powered by an external motor 42. The blower wheel 40 meets with the middle wall 30, in which there is provided an opening 44 (FIG. 4), through which air is sucked into the blower wheel 40. When the valve flaps 36 and 38 assume the positions as shown in FIG. 4 the air will thus be sucked through the channel 20 into the channel portion or chamber 34, while the same air will be blown out into the channel portion or chamber 32 and thus be let into the channel 16 as shown by arrows. If or when the valve flaps are invertedly positioned as shown in FIG. 1, then the suction chamber 34 will be connected with the channel 16, while the pressure chamber 32 is connected with the channel 20.

When grain has been filled into the store and is to be air dried the valve flaps 36 and 38 are positioned as shown in FIG. 4, whereby air is blown into the channels 2 and out through the wall openings 8 thereof, but not out through the rear ends of the channels, where the valve flap 28 will close for admission of air out through the slot 26. At the same time the outsluicing system 22 will prevent the air from escaping through the hopper 12, i.e. the entire blower capacity is used for blowing the air as drying air into and up through the grain.

When the grain is to be conveyed out of the drying store both of the valve flaps 36 and 38 are switched over to the positions shown in FIG. 1, whereby it will now be the suction chamber 34 which is connected with the channels 2, while the pressure chamber 32 is connected to the free atmosphere through the channel 20. As a result, the valve flap 28 may open for intake of outer air into and through the channels 2 such that a forwardly directed air flow is created in these channels while generally an interior subpressure will exist adjacent the wall openings 8 of the channels 2. This subpressure as largely caused by the flow of the air past the wall openings 8 and the guide flaps 10 thereof will give rise to the air and therewith the grain outside the openings 8 being sucked into the channels 2 and moved forwardly for delivery to the hopper 12, from which the grain is guided to the said delivery area through the outsluicing system 22, the delivery area being represented e.g. by a grain collecting vehicle or a conveyor leading to another grain store.

The tendacy for the sucked out grain to intrude into the blower housing can be prevented in many ways, e.g. by means of a high air box 14 having a vertical partition 46 as shown in FIGS. 1 and 3.

It will be appreciated that by the active exhaustion of the grain through the channel wall openings 8 it is ensured that problems as to air leaving the channels through the openings 8 will not occur, either during the final phase of the emptying of the store, i.e. any dusting up of or in the grain will be avoided.

In relevant known store systems having a desired inblow capacity of drying air it has so far been necessary to make use of a considerably increased blower effect for causing the grain to be let out of the store at an acceptable emptying rate, but it has been found that in connection with the invention an effective emptying of the store is achievable based on the same blower capacity as suitable for the injection of the drying air, and it is a remarkable advantage that it is thus sufficient to make use of a blower of a relatively low capacity.

As shown in FIGS. 1 and 3 the channels 2 are shaped with a cross sectional area which increases in the suction direction, this being particularly important for the final emptying of the store silo. During the emptying of the store the air velocity will thereby be relatively high in the rearmost, thin channel portions, whereby the exhaustion of grain through the wall openings 2 will be particularly effective at this place or area, i.e. the silo will get emptied primarily at the rear end, to which the grain will slide down. As the surface of the grain mass approaches the floor, a partly free suction in of air through the wall openings 8 will take place, whereby loose grain from the floor surface may be sucked into the channels. By this free suction the suction pressure in the channels will decrease, but at the same time the valve flap 28 will start closing the air intake slot 26, so the suction air is utilized well. As more and more wall openings 8 of the rear channel portions are gradually made free of grain the amount of air sucked in will increase, whereby the air velocity in the next channel portion will be sufficient to make the wall openings 8 thereof active for exhaustion of grain, and so forth.

In this manner there is automatically obtained a selective, progressive emptying of the silo bottom, whereby it is unnecessary to work with successively actuated closing valves for the wall openings 8.

In lieu of the blower arrangement shown a reversible axial blower or separate blowers for blowing and sucking, respectively, could be used, but the illustrated system having a single non-reversible radial blower has proved to be surprisingly effective and economical in use.

It will be understood that the apparatus according to the invention is well suited to handle granular material in general, i.e. the material handled by the apparatus should not necessarily be "grain".

The outsluicing system 22 is shown as a transverse conveyor having driving plates 50 projecting upwardly into an outlet groove underneath the hopper 12, but of course it will be possible to make use of other kinds of outsluicing systems.

FIG. 5 shows a modified design of the silo, in which the blower unit as designated 52 is connected with a main channel 54 forming a wall in a number of adjacent silo chambers, each of which is provided with bottom mounted channels 2 projecting from the main channel 54. At the outer free end of each of the channels 2 is provided a suction valve 56, the function of which corresponds to that of the valve box 24 of FIGS. 1 and 3.

The channels 2 of FIG. 5 are individually connected with the main channel 54, inside which is preferably mounted valve means (not shown) for closing the channels 2 as belonging to silo chambers not in use. Such valve means may be adjustable from outside—or from the inside of the main channel 54, when the latter is accessible for an attendant through an openable end wall 58. A pipe 60 penetrates through the wall 58. The pipe belongs to a conveyor system for conveying or sluicing out the grain material from the main channel.

By way of example this conveyor system may comprise a conveyor worm or a scraper conveyor.

The blowing in of air through the channels 2 may take place concurrently in all of the silo chambers in use, while if desired the emptying thereof may take place individually, by suitable actuation of the said main channel valves, such that the silo chambers may contain mutually different sorts of grain. When the blower unit 52 is switched over for suction from the main channel 54 the grain from the relevant silo chamber or chambers will be sucked into and through the channels 2 in the same manner as previously described, but now so as to be deposited in the main channel, from which the grain is taken out through the pipe 60 by means of the said conveyor system.

Figure 6:
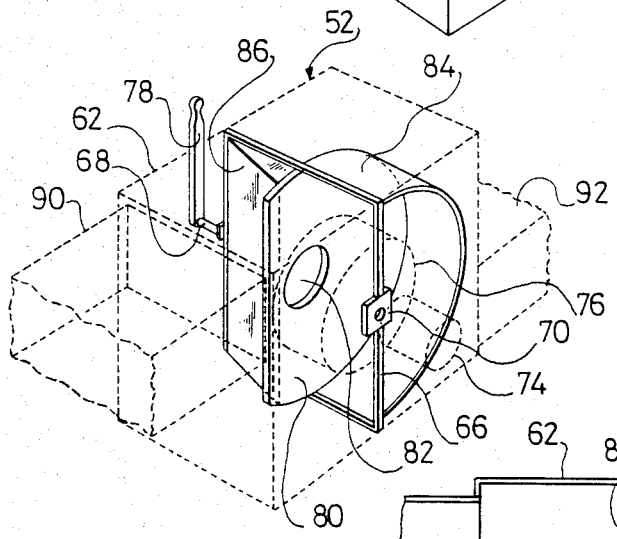
FIGS. 6 and 7 are illustrations of a modified suction blower unit.
Figure 7:
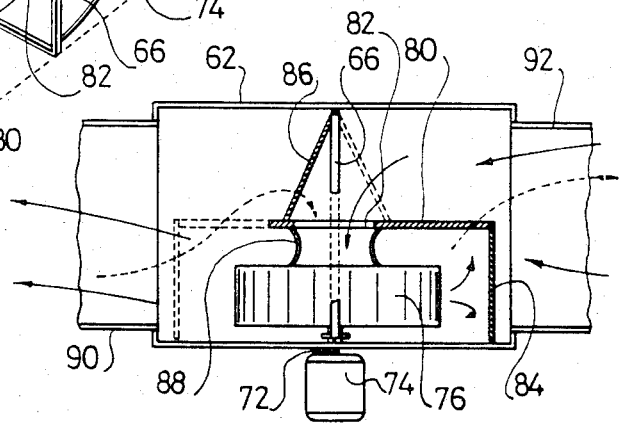

The blower unit 52 as indicated in FIG. 5 is different from the unit 18 of FIGS. 1 and 3, and it is illustrated in more detail in FIGS. 6 and 7. It comprises an outer housing 62 and an internal element 64, which is rotatably mounted in the housing 62 and is shown in full lines in FIG. 6. The element 64 is built on a rectangular frame 66, which is arranged crosswise in the housing 62 and rotatably secured to opposed side walls thereof so as to be rotatable or turnable about a horizontal middle axis. At one side, the frame 66 has a pivot pin 68 projecting through a tight bearing in the housing wall, while at its opposite side the frame 66 is provided with a bearing 70 for receiving the shaft 72 of the blower motor 74, FIG. 7. The blower motor 74 is secured to the outside of the housing 62 by suitable mounting means, and the shaft 72 carries a radial blower wheel 76 in the space inside the frame 66. At its outer end the pivot pin 68 is provided with a handle 78, by means of which the frame 66 may be rotated through 180° about the said horizontal axis into a corresponding, inverted position, now with the handle pointing downwardly. The frame 66 is provided with a peripheral sealing strip, which seals against the inside of the housing 62 in both of the said frame positions.

In its vertical middle plane the frame 66 is provided with a part-circular disc 80 shaped with a middle hole 82. At one side of the frame 66 the disc 80 is half-circular and serves to carry a half-cylindrical screen 84, which projects towards and closely against the motor carrying side wall of the housing 62, such that the screen 84 surrounds the blower wheel 76 half-cylindrically. To the other side of both the frame 66 and the disc 80 could be mounted a corresponding, but inverted half-cylindrical screen, but it is sufficient that a plate screen 86 is arranged between the frame 66 and the disc 80, when only the center hole 82 is hereby held open towards that side of the frame 66 which is oriented inversely of the opening of the half-cylindrical screen 76.

As shown in FIG. 7 the center hole 82 of the disc 80 is in permanent connection with an air intake nozzle 88 communicating with the central air intake of the blower wheel 76.

At one end the housing 62 is connected with a channel 90 and at the other end with a channel 92.

When the element 64 assumes the position shown in FIGS. 6 and 7 the blower wheel 76 will suck in air from the channel 92 and blow the air out into the space inside the screen, as open towards the channel 90, this space being sealed off from the space or chamber communicating with the channel 92 by means of the plate screen 86 and the frame 66 as sealingly engaging the housing.

For invertedly causing air to be sucked from the channel 90 it is sufficient to turn the element 64 through 180° by means of the handle 78, whereafter the suction intake to the blower wheel 76 will take place from the space or chamber of the housing 62 as now connected with the channel 90, while the half-cylindrical screen 84 about the pressure zone of the blower will now be open towards that end of the housing 62 which communicates with the channel 92, as indicated in dotted lines in FIG. 7.

I claim:

1. An apparatus for air drying a granular material in a drying store and for pneumatical emptying of the store, comprising a plurality of air channels extending along a bottom surface of the store and provided with wall openings for the inlet of drying air from the channels into the material and for the outlet of the material from said store through the channels, the channels being connected with means for blowing drying air into the channels and means for providing a flow of conveying air through the channels towards a collector area for the material to be exhausted from the store, wherein said means for providing the said conveying air flow comprises a suction blower which is connected with the channels at the ends thereof facing said collector area.

2. An apparatus according to claim 1, wherein said means for blowing drying air into the channels is connected with the channels at the collector area facing ends thereof.

3. An apparatus according to claim 2, wherein a valve is provided at the ends of the channels opposite said collector area facing ends, said valve, being actuated directly by the channel air and operable to close by an existing overpressure of drying air in the channel and to open for intake of conveying air when the channels are connected with the suction blower.

4. An apparatus according to claim 2, wherein said collector area facing ends of the channels are connected with a single blower which is shiftable by means of a switch system between operation as a blower for drying air and a suction blower for producing the conveying air flow.

5. An apparatus according to claim 4, wherein the blower is in permanent connection with a suction chamber and a pressure chamber, said chambers being alternatingly connectable with said channels and a channel connected to the free atmosphere, respectively, by means of switch valves of said switch system.

6. An apparatus according to claim 5, wherein said switch valves are constituted by rigid frame and plate portions of an element mounted in a blower housing in such a turnable manner that the element is switchable between a position, in which a half-cylindrical chamber portion about the stationary blower is open towards one end of a surrounding blower housing, while an opposite suction chamber portion is open towards the opposite end of the blower housing, and a position, in which the said chamber portions are open towards the respective blower housing ends in inverted order.

7. An apparatus according to claim 1, wherein said wall openings of the channels are provided with guide flaps which project obliquely into the channels in the suction direction thereof.

8. An apparatus according to claim 1, wherein said channels are designed with a cross sectional area, which is increasing as seen in the suction direction, and with wall openings located so as to enable the channels to cause a practically total suction emptying of the store.

9. An apparatus according to claim 1, wherein said channels are connected with a main channel, which distributes to the channels blowing air as well as suction air, the main channel being connected with conveyor means for removal of sluicing out said granular material from the store, which is fed to the main channel by suction from the channels.

* * * * *